US005534315A

United States Patent [19]

Witte

[11] Patent Number: 5,534,315

[45] Date of Patent: Jul. 9, 1996

[54] DECORATIVE ART FORM

[76] Inventor: Donald H. Witte, 500 Lakeside Dr., Altus, Okla. 73521

[21] Appl. No.: 405,734

[22] Filed: Mar. 17, 1995

[51] Int. Cl.[6] ..... B44F 3/00

[52] U.S. Cl. ..... 428/7; 40/550; 362/808; 428/120; 428/904.4

[58] Field of Search ..... 40/550; 362/808; 428/7, 120, 904.4

[56] References Cited

U.S. PATENT DOCUMENTS

| | | | |
|---|---|---|---|
| 3,607,582 | 9/1971 | Horacek | 428/7 X |
| 4,657,800 | 4/1987 | Long | 428/18 X |
| 4,966,793 | 10/1990 | Covell | 428/18 X |

*Primary Examiner*—Henry F. Epstein

[57] ABSTRACT

A decorative art form structured to be a substantially rigid and free-standing display is disclosed. The decorative art form includes a first sheet of material lying generally in a first plane and having a plurality of apertures formed therethrough in a predetermined pattern to outline the profile of the decorative art form. Also included is a second sheet of material lying generally in a second plane which is generally parallel to the first plane. The second sheet has a predetermined plurality of second apertures formed therethrough in a predetermined pattern which outlines the same profile as that outlined by the predetermined pattern of first apertures formed through the first sheet. A predetermined plurality of retainers are inserted into corresponding apertures of the first and second sheets to maintain the first and second sheets in a rigid and parallel relationship to form a free-standing decorative art form. One embodiment includes a predetermined art work pattern of colors on the front of the first sheet. Another embodiment includes a predetermined art work pattern of colors on the back of the second sheet as well as on the front of the first sheet. Another embodiment includes a lamp assembly in each retainer with the lamp assembly oriented to display light at the front of the decorative art form.

26 Claims, 6 Drawing Sheets

DECORATIVE ART FORM

BACKGROUND OF THE INVENTION

1. Field of the Invention

The present invention relates generally to art and decorations. More particularly, but not by way of limitation, this invention relates to decorative art forms which include colors, lights and shapes to enhance the beauty of the decorative art forms.

2. History of the Prior Art

In recent years there has been an increase in the use of lights, lighting and various displays for decorating for various special occasions and holidays, e.g. Christmas, Thanksgiving, Easter, Valentine's day, Fourth of July, Halloween, birth of a child, an anniversary, a birthday, etc. Christmas is one of the holidays which brings out a large amount of decorations both inside and outside of homes, offices, office buildings, businesses, parks, malls, etc.

Much of the decorations are flat, two-dimensional, color printed and painted placard-type forms which are hung or erected in the yard by means of a stake or prop attached to the form. These forms are usually made from wood, plastic, cardboard, corrugated materials, etc. Some more expensive versions are molded plastic with openings formed therein to hold lights. Forms without lights may be illuminated at night with separate flood or spot lights.

Other decorative forms include wire forms in which the wire or wires form the profile shape of the object and electrical wiring with lights are wrapped around or fastened to the wire form to illuminate the profile at night. During daylight hours when the illuminating lights are off, the nature of the object depicted by the wire form can be obscure and nondescriptive.

Other decorative forms include three-dimensional forms which are molded of plastic with the various colors formed in the plastic or are painted on the surface of the plastic. These type forms are provided with a light inside the form or are illuminated by a spot or flood light directed at the exterior of the form.

The present invention as claimed is intended to provide decorative art forms which eliminates or reduces many of the prior art deficiencies which include a cheap appearance, lack of a quality appearance in both daylight and nighttime, and lack of weather durability and survival. Many of the prior art forms are difficult and expensive to transport because of their size and shape. Many of the prior art forms lack details to provide a nice appearance and a sharp image and many do not display well when the lights are not burning.

SUMMARY OF THE INVENTION

One aspect of the present invention thus comprises a decorative art form structured to hold a predetermined number of lights operatively connected by wiring with the lights positioned to light the profile or perimeter of the form and a certain amount of the details of the form so that a nice sharp image of the form is easily seen.

Another aspect of the present invention comprises a decorative art form having a minimum of two sheets of flexible or semi-rigid material held in parallel relationship by a plurality of retainers placed in predetermined apertures formed in each sheet to form a free-standing, rigid member. Each retainer is also structured to hold a light therein.

Another aspect of the present invention comprises a decorative art form having a first sheet of flexible or semi-rigid material having a first side and a second side and a second sheet of flexible or semi-rigid material having a first side and a second side. The first sheet and/or the second sheet may be made to have a profile describing the particular decorative art form. A predetermined art work pattern of colors or a color is applied to the first side of the first sheet to show the details of the particular decorative art form. A predetermined art work pattern of colors or a color may also be applied to the second side of the second sheet to show the details of the particular decorative art form. Both the first sheet and the second sheet have a predetermined plurality of apertures formed therethrough in a predetermined pattern. The predetermined pattern outlines the profile and details of the particular decorative art form. Each one of a plurality of retainers are structured for insertion in a particular one of the apertures of both sheets to form a free-standing decorative art form with the second side of the first sheet facing the first side of the second sheet.

Another aspect of the present invention comprises a retainer for supporting a first sheet and a second sheet in a parallel and separated position to form a free-standing form. The retainer comprises a housing having a generally cylindrical first and a second and opposite end with each end having an outer surface portion which slopes upwardly toward the opposite end. Each upwardly sloping portion is followed by an annular depression which is followed by an outwardly protruding annular extension. A predetermined number of radial slots are formed in each end of the retainer to allow the remaining sloping outer surface portion to spring inwardly upon insertion of the end into an aperture of either sheet and to then spring outwardly when the annular depression is positioned opposite the sheet to lock the retainer to the sheets to support the sheets in a parallel and separated position. The retainer is structured to receive and hold a lamp to provide light to the first side of the first sheet.

BRIEF DESCRIPTION OF THE DRAWINGS

Other advantages and features of the invention will become more apparent with reference to the following detailed description of a presently preferred embodiment thereof in connection with the accompanying drawings, wherein like reference numerals have been applied to like elements, in which.

DETAILED DESCRIPTION

Figure 1:
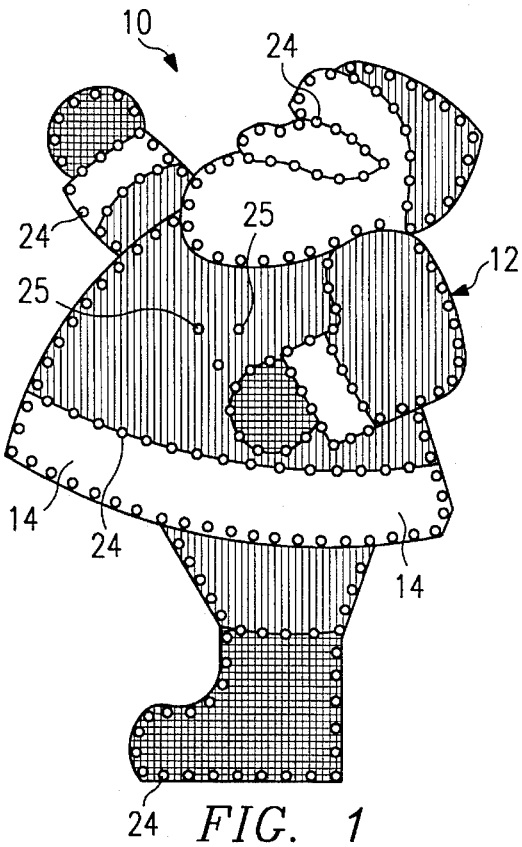
FIG. 1 is a simplified front elevation view of a decorative art form constructed according to the present invention.
Figure 2:
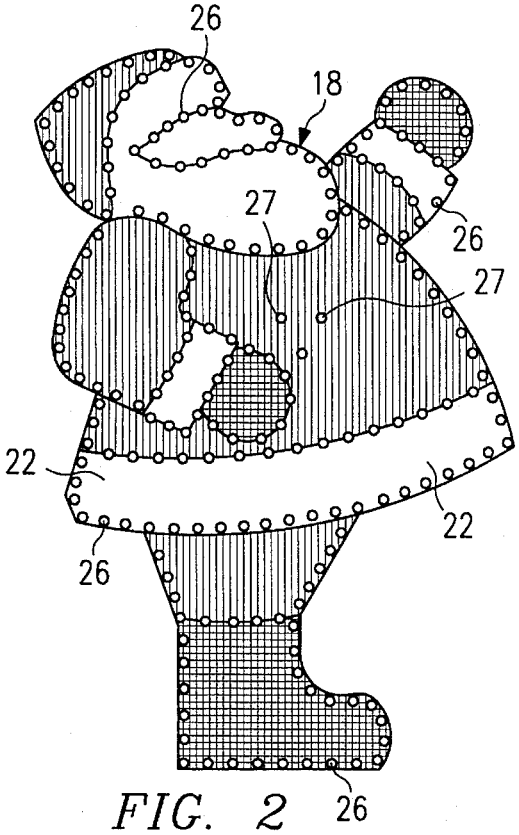
FIG. 2 is a simplified rear elevation view of the decorative art form of FIG. 1.
Figure 3:
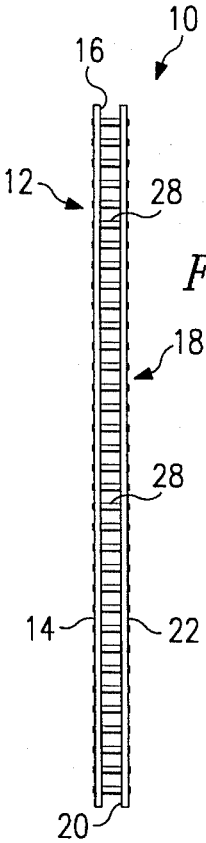
FIG. 3 is a simplified side elevation view of the decorative art form of FIG. 1.

Referring now to the drawings and in particular FIGS. 1–3, shown therein and generally designated by the reference character 10 is one embodiment of a decorative art form which incorporates the present invention. The decorative art form 10 comprises a first, facing or cosmetic sheet 12 having a first side 14 and a second side 16 opposite the first side 14. A second or back sheet 18 has a first side 20 and a second side 22 opposite the first side 20. The first side 14 of first, facing or cosmetic sheet 12 is shown in FIG. 1. The second side 22 of the second or back sheet 18 is shown in FIG. 2. It will be appreciated that the second side 22 of second sheet 18 is a mirror image of first side 14 of first sheet 12.

A predetermined plurality of apertures 24 are formed in first sheet 12 in a predetermined pattern with the number of apertures 24 and the pattern of apertures 24 being dictated by the particular decorative art form being configured. In the preferred embodiment, apertures 24 are positioned around the perimeter or profile of the decorative art form 10 to outline the profile and are also positioned within the perimeter or profile of the decorative art form 10 to outline the details of the decorative art form 10. It will be appreciated that for some particular decorative art forms apertures 25 may be added, beyond the lines of art, for the purpose of structural integrity. It will be appreciated that the decorative art form of FIG. 1 is a Santa Claus and the apertures depict the overall profile of Santa Claus as well as the hat, beard, arm, mittens, boots, fur, etc.

A predetermined plurality of apertures 26 are also formed in second sheet 18 in a predetermined pattern with the number of apertures 26 and the pattern of apertures 26 being dictated by the particular decorative art form and structural requirements thereof being configured and is normally dictated by the plurality and pattern of apertures 24 formed in first sheet 12. It will be appreciated that for some particular decorative art forms apertures 27 may be added, beyond the lines of art, for the purpose of structural integrity to align with apertures 25 in first sheet 12, if apertures 25 are included for structural integrity.

It will also be appreciated that if the first side 20 of second sheet 18 is positioned against second side 16 of first sheet 12, the corresponding apertures are in alignment, for example, the apertures 26 in the toe of the boot of second sheet 18 align with the apertures 24 in the toe of the boot of first sheet 12, etc.

It will also be appreciated that an appropriate art work pattern of colors or a color is applied to the first side 14 of first sheet 12, for example, black or brown boots and mittens, red coat with white trim, red cap with white trim, white beard, etc. to highlight the details of the decorative art form 10.

It will also be appreciated that an appropriate art work pattern of colors or a color can be applied to the second side 22 of second sheet 18 as was applied to the first side 14 of first sheet 12 if desired. The colors may be applied using conventional methods which are well known in the art.

It will be appreciated that the flexible or semi-rigid sheets may be made of, but not limited to, a variety of materials, such as: 1) plastics (thermal formed and thermo set), 2) metals (steel, non-ferrous metals, etc.), 3) fibrous material (wood, paper, cardboard, etc.) and 4) combinations of 1, 2 and 3 (laminates, reinforced, coated, embossed, foamed, etc.). The list of materials suitable for the flexible or semi-rigid sheets really includes almost all commercially available materials except glass, clay, porcelain, ceramics, hi-tech engineering materials, etc.

With reference to FIG. 3, first sheet 12 and second sheet 18 are shown positioned adjacent each other with the first side 20 of second sheet 18 facing the second side 16 of first sheet 12 and held in a parallel relationship by a plurality of retainers 28 positioned through apertures 24 and 26 in a locking relationship. Each retainer 28 is structured to receive and hold or maintain a lamp assembly in position where the lamp of the lamp assembly is able to provide light through or to the front of the decorative art form 10. The normal wiring connecting the plurality of lamp assemblies is in place between the first sheet 12 and the second sheet 18 so the wiring is not visible from the front or rear of the decorative art form 10. Details of the structure of the retainer 28 will be discussed below.

Figure 4:
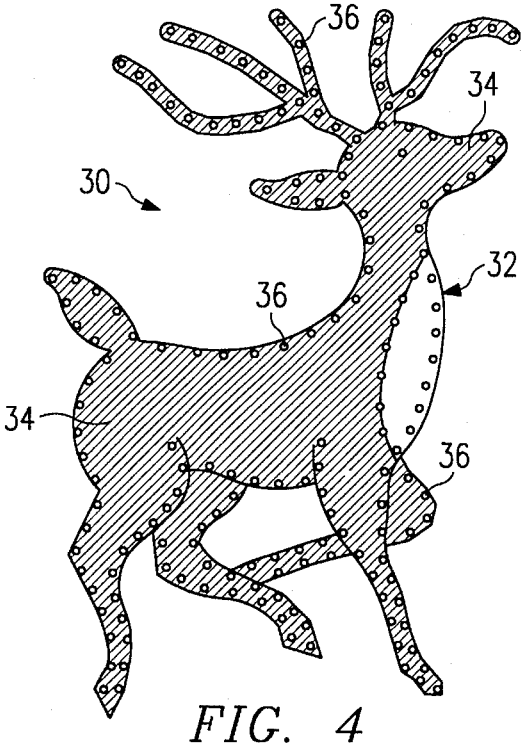
FIG. 4 is a simplified front elevation view of another embodiment of a decorative art form constructed according to the present invention.

Decorative art form 30 is disclosed in FIG. 4 and is an additional embodiment of the decorative art form of the present invention. Decorative art form 30 comprises a first, facing or cosmetic sheet 32 having a first side 34 and a second side (not shown) opposite the first side 34. A second sheet (not shown) is behind first sheet 32 and is held in a parallel relationship by a plurality of retainers (not shown) positioned through apertures 36 in first sheet 32 and through apertures (not shown) in second sheet (not shown) behind first sheet 32. The structure of decorative art form 30 is like the structure of decorative art form 10 but displays a reindeer rather than a Santa Claus. Apertures 36 are positioned around the perimeter or profile of decorative art form 30 to outline the profile and are also positioned within the perimeter or profile to outline the details of the decorative art form 30. The retainers, in structure and function, are the same as retainers 28 in decorative art form 10. It will be appreciated that appropriate colors (brown or shades of brown) are applied to the first side 34 of first sheet 32 to highlight the details of the decorative art form 30.

Figure 5:
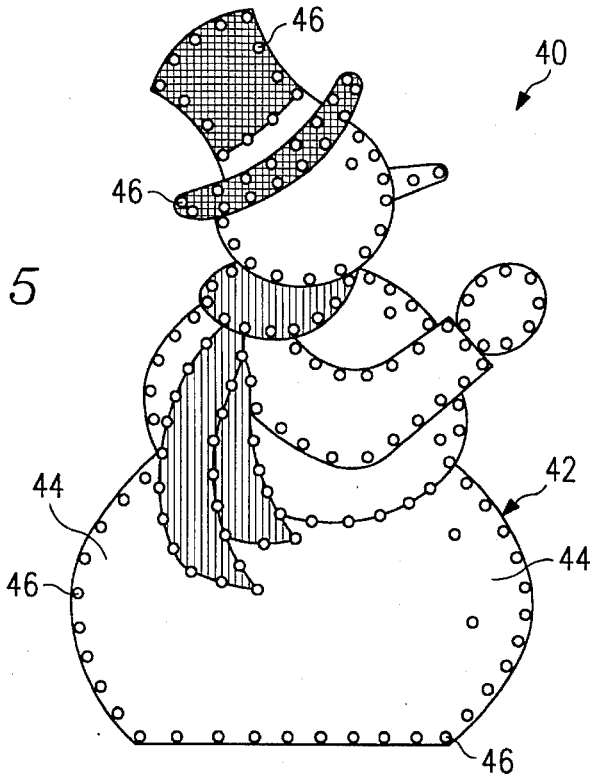
FIG. 5 is a simplified front elevation view of yet another embodiment of a decorative art form constructed according to the present invention.

Decorative art form 40 is disclosed in FIG. 5 and is an additional embodiment of the decorative art form of the present invention. Decorative art form 40 comprises a first sheet 42 having a first side 44 and a second side (not shown) opposite the first side 44. A second sheet (not shown) is behind first sheet 42 and is held in a parallel relationship by a plurality of retainers (not shown) positioned through apertures 46 in first sheet 42 and through apertures (not shown) in second sheet (not shown) behind first sheet 42. The structure of decorative art form 40 is like the structure of decorative art form 10 but displays a Snowman rather than a Santa Claus. Apertures 46 are positioned around the perimeter or profile of decorative art form 40 to outline the profile and are also positioned within the perimeter or profile to outline the details of the decorative art form 40. The retainers, in structure and function, are the same as retainers 28 in decorative art form 10. It will be appreciated that appropriate colors are applied to at least the hat (black), scarf (red), etc. to highlight the details of decorative art form 40.

Figure 6:
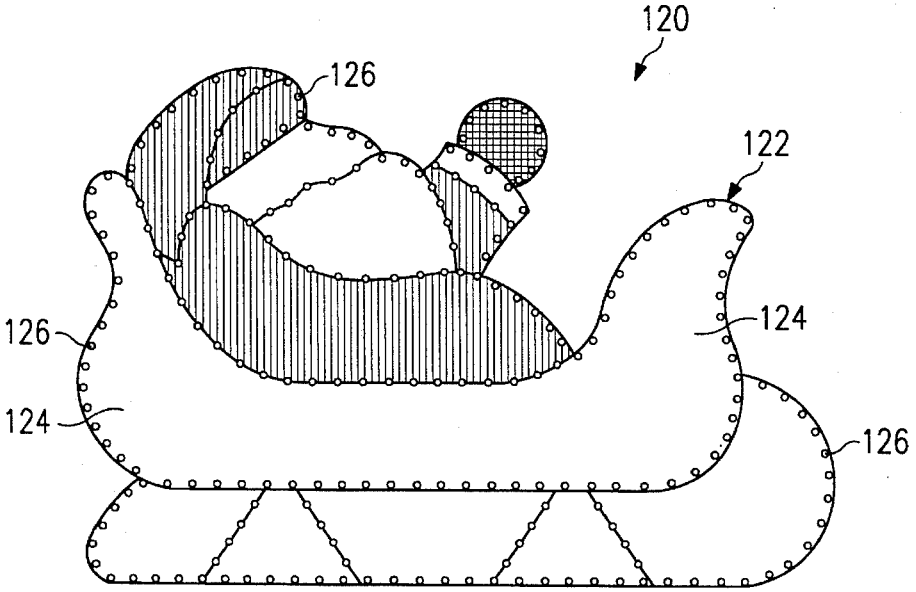
FIG. 6 is a simplified front elevation view of yet another embodiment of a decorative art form constructed according to the present invention.

Decorative art form 120 is disclosed in FIG. 6 and is an additional embodiment of the decorative art form of the present invention. Decorative art form 120 comprises a first sheet 122 having a first side 124 and a second side (not shown) opposite the first side 124. A second sheet (not shown) is behind first sheet 122 and is held in a parallel relationship by a plurality of retainers (not shown) positioned through apertures 126 in first sheet 122 and through apertures (not shown) in second sheet (not shown) behind first sheet 122. The structure of decorative art form 120 is like the structure of decorative art form 10 but displays a Santa and sleigh rather than a Santa Claus. Apertures 126 are positioned around the perimeter or profile of decorative art form 120 to outline the profile and are also positioned within the perimeter or profile to outline the details of the decorative art form 120. The retainers, in structure and function, are the same as retainers 28 in decorative art form 10. It will be appreciated that appropriate colors or an art work pattern of colors are applied to the sleigh (brown or black) and Santa (as in FIG. 1) to highlight the details of decorative art form 120.

Figure 8:
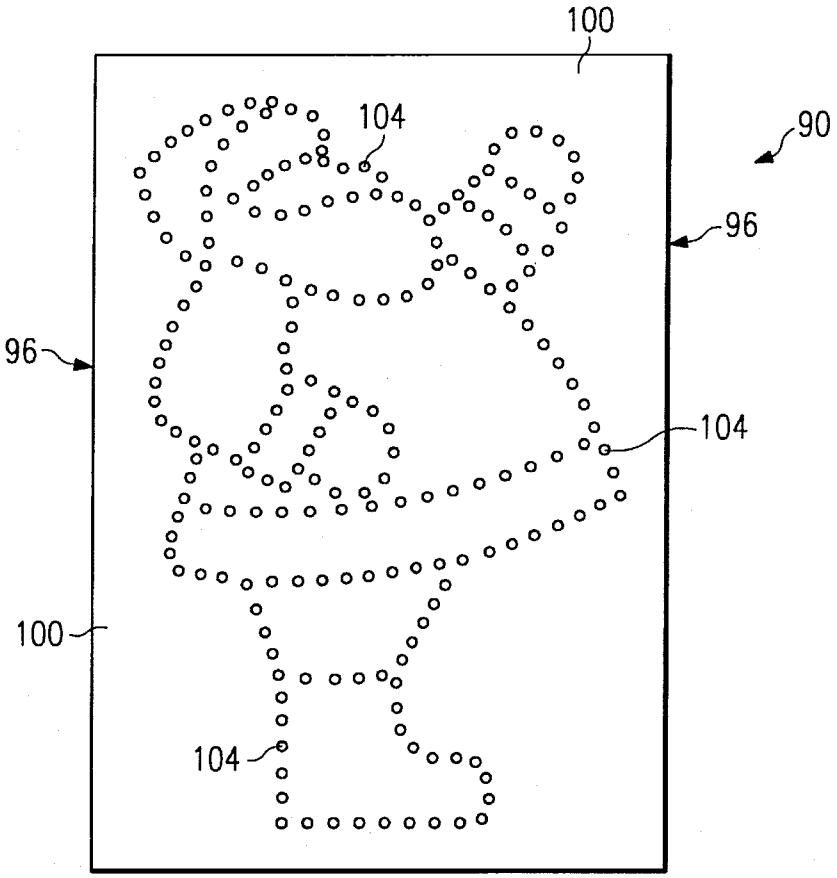
FIG. 8 is a simplified rear elevation view of the decorative art form of FIG. 7.
Figure 7:
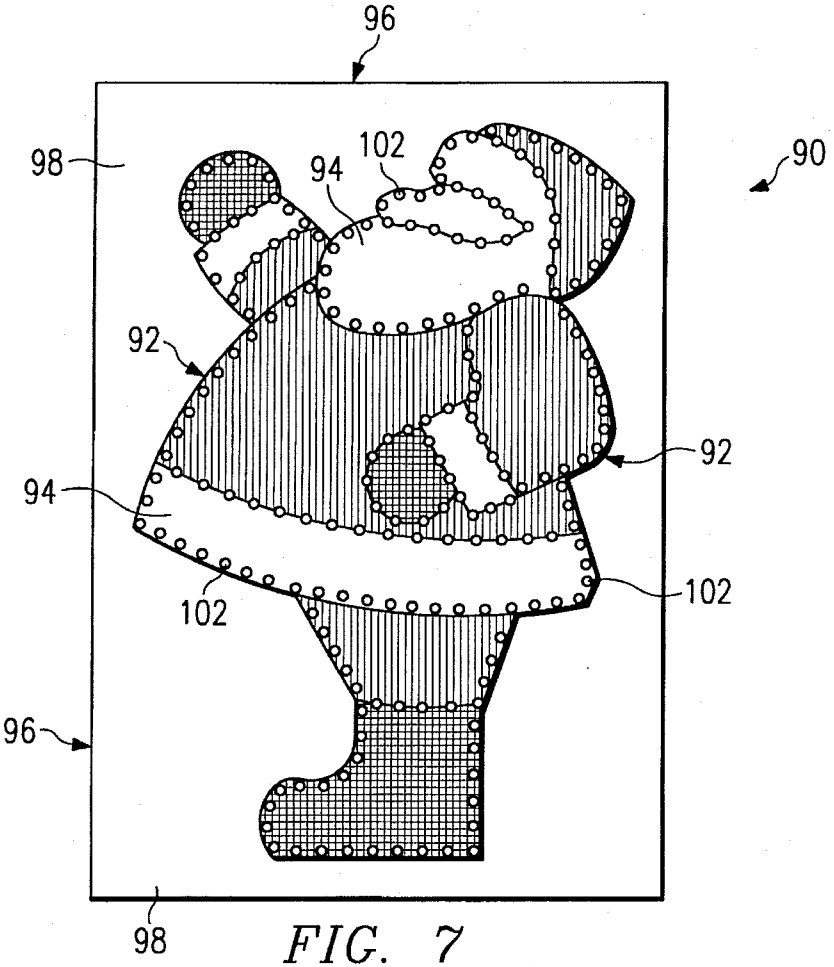
FIG. 7 is a simplified front elevation view of yet another embodiment of a decorative art form constructed according to the present invention.

Decorative art form 90 is disclosed in FIGS. 7 and 8 and is an additional embodiment of the decorative art form of the present invention. Decorative art form 90 comprises a first, facing or cosmetic sheet 92 having a first side 94 and a second side (not shown) opposite the first side 94. In this embodiment, first sheet 92 is made having a profile describing the decorative art form, which in this particular disclosure and figure is a Santa Claus. A second or back sheet 96 has a first side 98 and a second side 100 (see FIG. 8) opposite the first side 98. In this embodiment, second sheet 96 is made not having a profile describing the decorative art form but as an example is in the form of a rectangle.

A predetermined plurality of apertures 102 are formed in first sheet 92 in a predetermined pattern with the number of apertures 102 and the pattern of apertures 102 being dictated by the particular decorative art form being configured, which in this disclosure is a Santa Claus. In the preferred embodiment, apertures 102 are positioned around and near the perimeter or profile of the decorative art form 90 to outline the profile and are also positioned within the perimeter or profile of the decorative art form 90 to outline the details of the decorative art form 90, such as the hat, beard, arm, mittens, boots, fur, etc.

A predetermined plurality of apertures 104 are also formed in second sheet 96 in a predetermined pattern with the number of apertures 104 and the pattern of apertures 104 being dictated by the particular decorative art form being configured. It will be appreciated that the plurality of apertures 104 depict the overall profile of Santa Claus as well as the hat, beard, arm, mittens, boots, fur, etc.

It will be appreciated that first sheet 92 is positioned adjacent to second sheet 96 with the first side 98 of second sheet 96 facing the second side (not shown) of first sheet 92 and held in a parallel relationship by a plurality of retainers (not shown) positioned through apertures 102 in the first sheet 92 and through apertures 104 in second sheet 96.

It will be appreciated that an appropriate art work pattern of colors are applied to the first side 94 of first sheet 92, for example, brown or black boots and mittens, red coat with white trim, red cap with white trim, white beard, etc. to highlight the details of the decorative art form 90. It will also be appreciated that an appropriate art work pattern of colors can be applied to the second side 100 of second sheet 96 as was applied to the first side 94 of first sheet 92 if desired.

Figure 9:
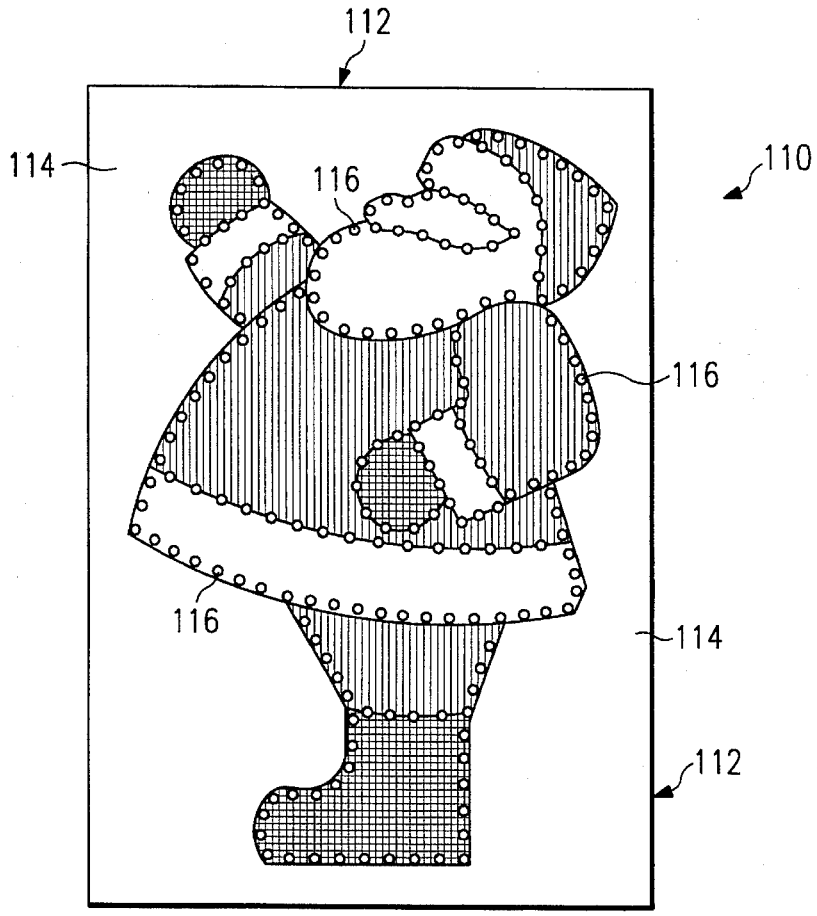
FIG. 9 is a simplified front elevation view of yet another embodiment of a decorative art form constructed according to the present invention.

Decorative art form 110 is disclosed in FIGS. 8 and 9 and is an additional embodiment of the decorative art form of the present invention. Decorative art form 110 comprises a first, facing or cosmetic sheet 112 (see FIG. 9) having a first side 114 and a second side (not shown) opposite the first side 114. In this embodiment, first sheet 112 is made not having a profile describing the decorative art form, which in this particular disclosure and figure is a Santa Claus. A second or back sheet is identical to second sheet 96 of the decorative art form 90 shown in FIGS. 7 and 8 and has a first side 98 (see FIG. 7) and a second side 100 (see FIG. 8) opposite the first side 98. In this embodiment, second sheet 96 is also made not having a profile describing the decorative art form but as an example is in the form of a rectangle.

A predetermined plurality of apertures 116 are formed in first sheet 112 in a predetermined pattern with the number of apertures 116 and the pattern of apertures 116 being dictated by the particular decorative art form being configured, which in this disclosure is a Santa Claus. In the preferred embodiment, apertures 116 are positioned to outline or form the profile and are also positioned within the profile of the decorative art form 110 to outline the details of the decorative art form 110, such as the hat, beard, arm, mittens, boots, fur, etc.

A predetermined plurality of apertures 104 are also formed in second sheet 96 in a predetermined pattern with the number of apertures 104 and the pattern of apertures 104 being dictated by the particular decorative art form being configured. It will be appreciated that the plurality of apertures 104 depict the overall profile of Santa Claus as well as the hat, beard, arm, mittens, boots, fur, etc.

It will be appreciated that first sheet 112 is positioned adjacent second sheet 96 with the first side 98 of second sheet 96 facing the second side (not shown) of first sheet 112 and held in a parallel relationship by a plurality of retainers (not shown) positioned through apertures 116 in the first sheet 112 and through apertures 104 in second sheet 96.

It will be appreciated that decorative art forms, in accordance with the present invention, may provide decorating for various special occasions and holidays, e.g. Christmas, Thanksgiving, Easter, Valentine's day, Fourth of July, Halloween, birth of a child, an anniversary, a birthday, etc. It will be appreciated that the inventive decorative art forms may be displayed by attaching or hanging the decorative art forms on a building wall, a door, a window, a tree, a shrub, a fence, etc. or placed in the yard in front of a home or other building by placing a couple of metal or wooden stakes down between the sheets and into the ground to support the decorative art form in an upright position.

Figure 10:
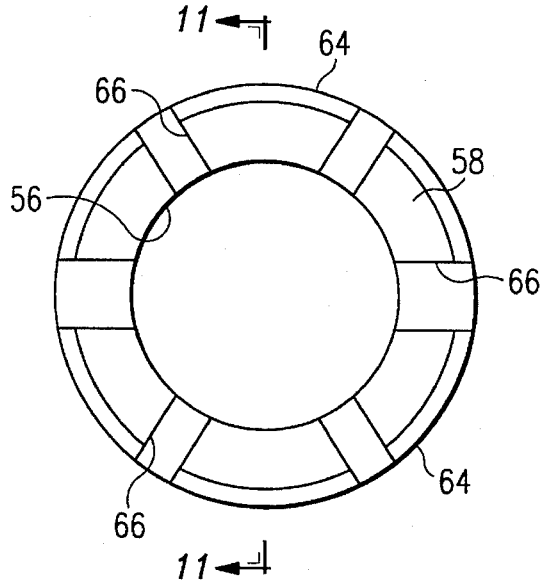
FIG. 10 is a simplified enlarged front elevation view of the retainer of the present invention.
Figure 11:
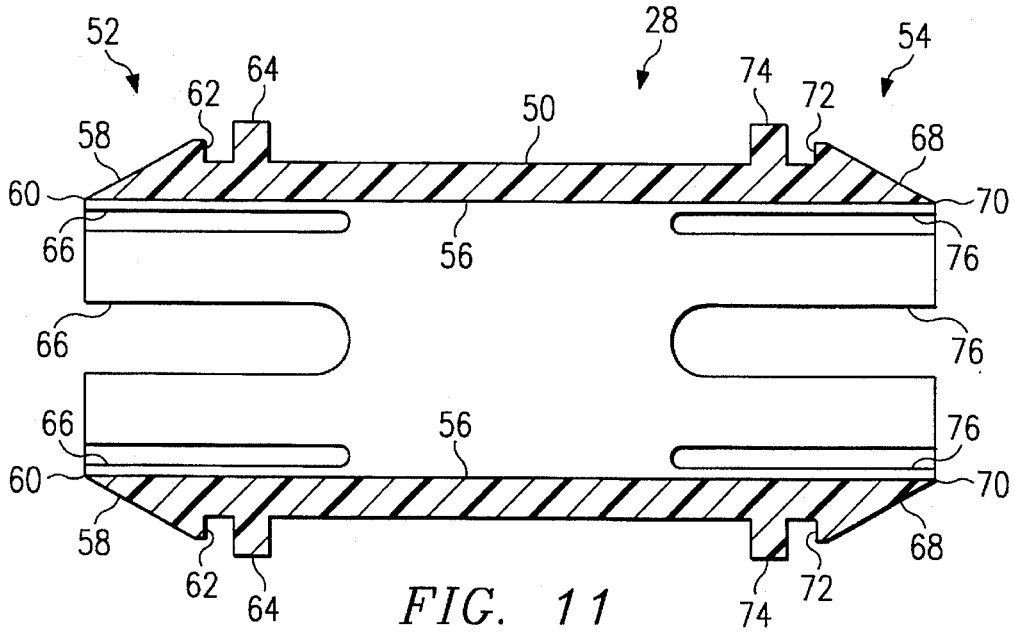
FIG. 11 is a simplified enlarged sectional view of the retainer of the present invention, as seen along lines 11—11 in FIG. 10.

With reference to FIGS. 10 and 11, retainer 28 (and the other retainers in the other embodiments) is disclosed as comprising a generally cylindrical first end 52 and a generally cylindrical second end 54 which is opposite first end 52 and connected by a generally cylindrical housing 50. An axial bore or void 56 extends through retainer 28. Outer surface portion 58 of first end 52 slopes upwardly from end 60 a predetermined axial distance toward second end 54. Outer surface portion 58 is followed, in the axial direction toward second end 54, by an annular depression 62 which is structured in width to receive either the first sheet or the second sheet of a decorative art form of the present invention. Annular depression 62 is followed, in the axial direction toward second end 54, by an outwardly protruding annular extension or ring 64. A predetermined number of slots or voids 66 are formed in an axial direction in the wall of first end 52 and extend axially along the length of retainer 28 resulting in extensions or fingers being formed in the wall of first end 52. Two opposing slots or voids 66 are structured to be of sufficient width to allow wires of a lamp assembly of a string of lamp assemblies to be placed in the slots or voids 66 as shown in FIG. 12.

At the risk of being repetitive, since second end 54 is a duplicate of first end 52, the structure of second end 54 will be discussed. Outer surface portion 68 of second end 54 slopes upwardly from end 70 a predetermined axial distance toward first end 52 Outer surface portion 68 is followed, in the axial direction toward first end 52, by an annular depression 72 which is structured in width to receive either the first sheet or the second sheet of a decorative art form of the present invention. Annular depression 72 is followed, in the axial direction toward first end 52, by an outwardly protruding annular extension or ring 74. A predetermined number of slots or voids 76 are formed in an axial direction in the wall of second end 54 and extend axially along the length of retainer 28 resulting in extensions or fingers being formed in the wall of second end 54. Two opposing slots or voids 76 are structured to be of sufficient width to allow wires of a lamp assembly of a string of lamp assemblies to be placed in the slots or voids 76 as shown in FIG. 12. Any additional slots are of sufficient width to accommodate at least one or two wires in each slot.

Figure 13:
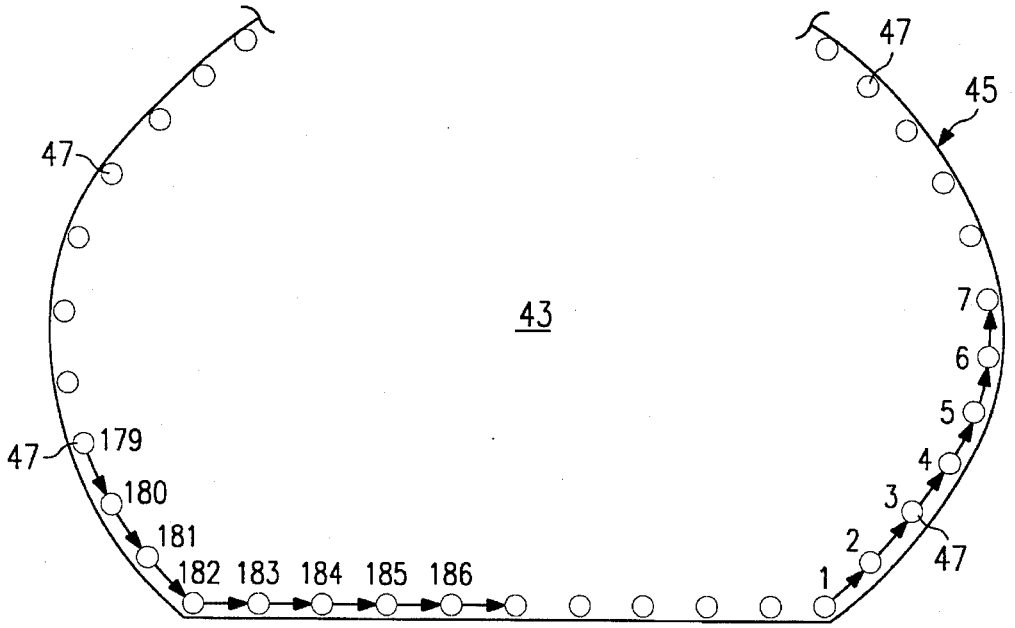
FIG. 13 is a partial enlarged elevation view of the first side of the second sheet of the decorative art form of FIG. 5.
Figure 12:
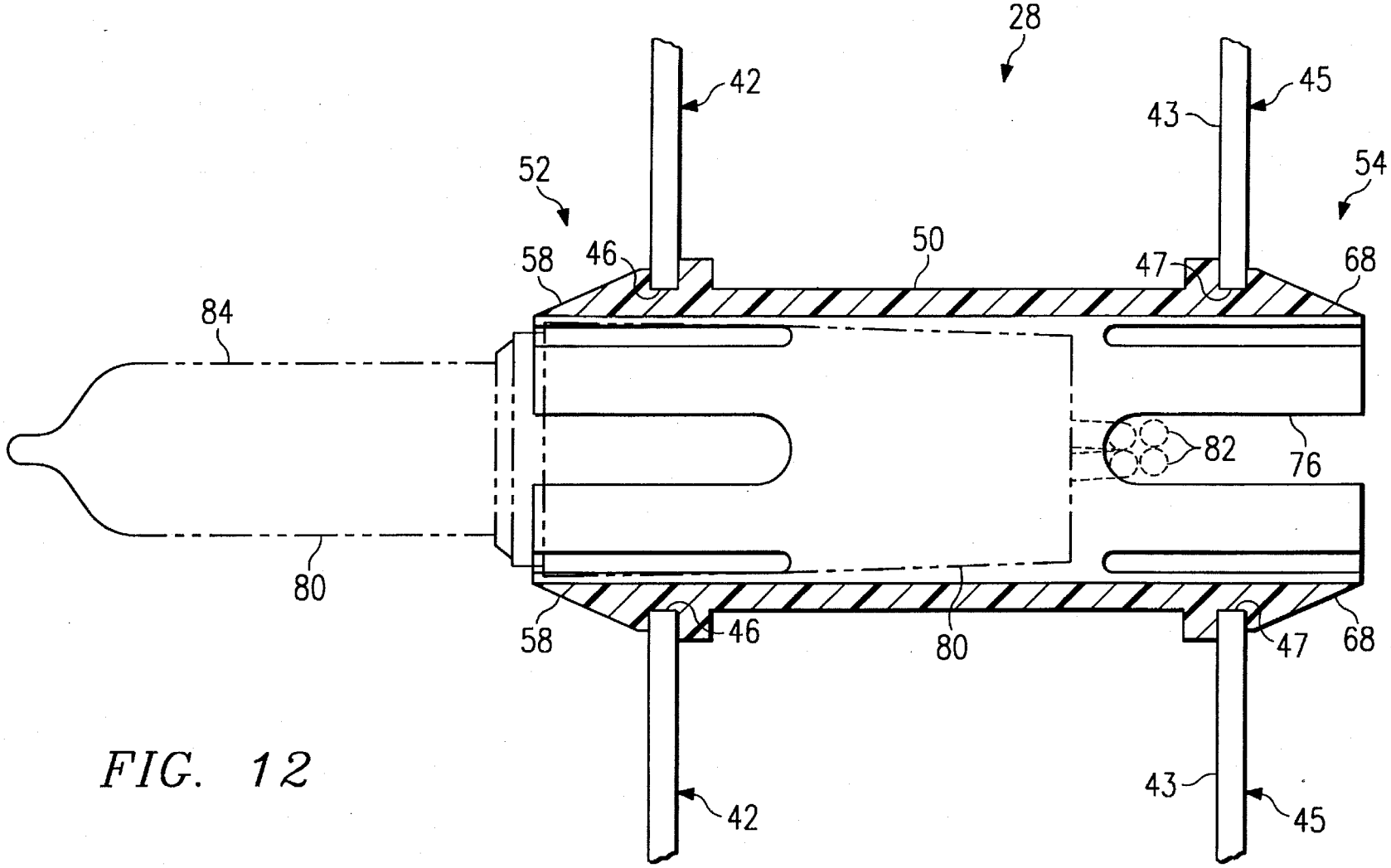
FIG. 12 is a simplified enlarged side sectional view of the retainer in operative position in the present invention with a phantom outline showing a lamp assembly disposed inside the housing of the retainer.

With reference to FIGS. 11, 12 and 13, the process of placing a lamp assembly in a retainer and placing a predetermined end of the retainer (determined by the lamp assembly position) in a predetermined aperture in the second sheet, then repeating the process per a progression shown in a wiring schematic, until all the apertures hold a retainer with a lamp assembly positioned in a retainer and then placing the opposite end of the retainer in the first sheet to form a free-standing (without external support) decorative art form will be discussed. For explanatory purposes, a string of conventional mini-light decorative bulbs and lamp assemblies will be used to show the above mentioned process. Second sheet 45 of decorative art form 40 is positioned with the first side 43 facing toward the individual putting the elements together. The wiring schematic diagram comprises lines drawn on first side 43 between each individual aperture 47 with a number placed beside each individual aperture 47 to indicate the sequence (starting with #1 and increasing in number) to be used in filling apertures 47 with a retainer 28. Starting with the first lamp assembly 80 (nearest the electrical plug) of the string of lamp assemblies, the lamp and husk or socket (lamp assembly) 80 is inserted into retainer 28 as shown in FIG. 12. The wiring 82 is placed in a directional choice of slots 66 with the two opposing wider slots 66 being capable of receiving multiple wires 82 with the wires 82 extending outwardly in a generally ninety degree orientation from the axis of retainer 28. End 54 of retainer 28 is then inserted into the aperture 47 which is marked #1. Force is exerted on retainer 28 along the axis thereof to force the outer surface portion 68 to spring inwardly until annular depression 72 of retainer 28 is aligned with second sheet 45, at which time, outer surface portion 68 will spring outwardly and lock retainer 28 to second sheet 45 and captivate wires 82 inside the first surface 43 of second sheet 45 in an oriented manner predetermined by selection of slots 76 from which wires 82 exit retainer 28. It will be appreciated that reasonable commercial clearances and tolerances are provided between the thickness of second sheet 45 and the width of annular depression 72 so that second sheet 45 and retainer 28 are locked together. The remaining lamp assemblies of the string of conventional mini-light decorative bulb and lamp assemblies will be inserted in retainers and the retainers inserted into the numbered apertures in sequences as dictated by the numbers placed at the apertures until all lamp assemblies and retainers are in place and all apertures located as part of the art form contain a retainer with a lamp assembly held therein. The first or cosmetic sheet 42 is placed with the second side facing the retainers and the apertures 46 aligned with corresponding apertures 47 (which contain retainers and lamp assemblies). Circumambient force is then exerted around each aperture 46 until sheet 42 is positioned against outwardly protruding annular extension or ring 64 and outer surface portion 58 will spring outwardly and lock retainer 28 to first sheet 42. Lamp 84 will then be extending outwardly from the first side 44 of first sheet 42.

It will be appreciated that retainers 28 can also be used independently as structural members between first and second sheets without involvement with lights and wires of the art form.

It is thus believed that the construction and details of the present invention will be apparent from the foregoing description. While the apparatus shown or described has been characterized as being preferred, it will be obvious that various changes and modifications may be made therein without departing from the spirit and scope of the invention as defined in the following claims.

What is claimed is:

1. A decorative art form structured to be a substantially rigid and free-standing display, said decorative art form comprising:

a first sheet of material lying generally in a first plane and having a first side and a second side, said first sheet having a predetermined plurality of first apertures formed therethrough in a predetermined pattern to outline the profile of the decorative art form;

a second sheet of material lying generally in a second plane and having a first side and a second side, said second plane generally parallel to said first plane, said second sheet positioned with said first side of said second sheet facing said second side of said first sheet, said second sheet having a predetermined plurality of second apertures formed therethrough in a predetermined pattern, said predetermined pattern of second apertures outline the same profile as that outlined by said predetermined pattern of first apertures formed through said first sheet; and a predetermined plurality of retainers having a first end and a second end with each predetermined one of said predetermined plurality of retainers having a first end inserted into a predetermined one of said predetermined plurality of first apertures and a second end inserted into a corresponding aperture of said predetermined plurality of second apertures to maintain said first and said second sheet in a rigid and parallel relationship to form a free-standing decorative art form.

2. The decorative art form as set forth in claim 1 further including a predetermined art work pattern of colors on said first side of said first sheet.

3. The decorative art form as set forth in claim 2 further including a predetermined art work pattern of colors on said second side of said second sheet, said predetermined art work pattern of colors on said second side of said second sheet is the same predetermined art work pattern of colors as that on said first side of said first sheet.

4. The decorative art form as set forth in claim 1 wherein each one of said predetermined plurality of retainers being structured to receive and hold one of a predetermined number of lamp assemblies in an oriented position.

5. The decorative art form as set forth in claim 4 further including a wiring diagram on said first side of said second sheet showing the path and layout for the installation of wiring and lamp assemblies.

6. The decorative art form as set forth in claim 1 wherein said material of said first sheet and said second sheet is semi-rigid.

7. The decorative art form as set forth in claim 1 wherein said first sheet of material comprises plastic.

8. The decorative art form as set forth in claim 1 wherein said first sheet of material comprises metal.

9. The decorative art form as set forth in claim 1 wherein said first sheet of material comprises fibrous material.

10. The decorative art form as set forth in claim 1 wherein said second sheet of material comprises plastic.

11. The decorative art form as set forth in claim 1 wherein said second sheet of material comprises metal.

12. The decorative art form as set forth in claim 1 wherein said second sheet of material comprises fibrous material.

13. The decorative art form as set forth in claim 1 wherein said first sheet has a profile describing the decorative art form.

14. The decorative art form as set forth in claim 1 wherein said second sheet has a profile describing the decorative art form.

15. A decorative art form structured to be a substantially rigid and free-standing display and to hold a predetermined number of lamp assemblies operatively connected by wiring to enhance the decorative art form, said decorative art form comprising:

a first sheet of material lying generally in a first plane and having a first side and a second side, said first sheet having a profile describing the decorative art form, said first sheet having a predetermined plurality of first apertures formed therethrough in a predetermined pattern;

a second sheet of material lying generally in a second plane and having a first side and a second side, said second plane generally parallel to said first plane, said second sheet positioned with said first side of said second sheet facing said second side of said first sheet, said second sheet having a profile describing the decorative art form, said profile of said second sheet is the same profile as the profile of said first sheet, said second sheet having a predetermined plurality of second apertures formed therethrough in a predetermined pattern, said predetermined pattern of second apertures is the same predetermined pattern as that of said predetermined pattern of first apertures formed through said first sheet; and a predetermined plurality of retainers having a first end and a second end with each predetermined one of said predetermined plurality of retainers having a first end inserted into a predetermined one of said predetermined plurality of first apertures and a second end inserted into a corresponding aperture of said predetermined plurality of second apertures to maintain said first and said second sheet in a rigid and parallel relationship to form a free-standing decorative art form, each one of said predetermined plurality of retainers being structured to receive and hold one of said predetermined number of lamp assemblies in an oriented position.

16. The decorative art form as set forth in claim 15 further including a predetermined art work pattern of colors on said first side of said first sheet.

17. The decorative art form as set forth in claim 16 further including a predetermined art work pattern of colors on said second side of said second sheet.

18. The decorative art form as set forth in claim 15 wherein said material of said first sheet and said second sheet is semi-rigid.

19. A decorative art form structured to be a substantially rigid and free-standing display, said decorative art form comprising:

a first sheet of material lying generally in a first plane and having a first side and a second side, said first side having a predetermined art work pattern of colors thereon describing the decorative art form, said first sheet having a predetermined plurality of first apertures formed therethrough in a predetermined pattern to outline the profile of the decorative art form;

a second sheet of material lying generally in a second plane and having a first side and a second side, said second plane generally parallel to said first plane, said second sheet positioned with said first side of said second sheet facing said second side of said first sheet, said second sheet having a predetermined plurality of second apertures formed therethrough in a predetermined pattern, said predetermined pattern of second apertures outline the same profile as that outlined by said predetermined pattern of first apertures formed through said first sheet; and a predetermined plurality of retainers having a first end and a second end with each predetermined one of said predetermined plurality of retainers having a first end inserted into a predetermined one of said predetermined plurality of first apertures and a second end inserted into a corresponding aperture of said predetermined plurality of second apertures to maintain said first and said second sheet in a rigid and parallel relationship to form a free-standing decorative art form.

20. The decorative art form as set forth in claim 19 further including a predetermined art work pattern of colors on said second side of said second sheet.

21. The decorative art form as set forth in claim 20 wherein each one of said predetermined plurality of retainers being structured to receive and hold one of a predetermined number of lamp assemblies in an oriented position.

22. The decorative art form as set forth in claim 19 wherein each one of said predetermined plurality of retainers being structured to receive and hold one of a predetermined number of lamp assemblies in an oriented position.

23. The decorative art form as set forth in claim 19 wherein said material of said first sheet and said second sheet is semi-rigid.

24. A retainer to support a first sheet and a second sheet in a parallel and separated position when a retainer is inserted in each one of a plurality of predetermined apertures in the first and second sheets, said retainer comprising:

a housing having a generally cylindrical first end and a generally cylindrical second end which is opposite said generally cylindrical first end, said generally cylindrical first and second ends each having an outer surface portion which is followed by an annular depression which is followed by an outwardly protruding annular extension, said generally cylindrical first and second ends each having a predetermined number of axial slots formed therein to allow said outer surface portion to spring inwardly upon insertion into an aperture of either of said sheets and to spring outwardly when the annular depression is positioned opposite the sheet to lock the retainer to the sheet and to support the first and second sheets in a parallel position when the opposite end of said housing is inserted into a corresponding aperture in the other sheet.

25. The retainer as set forth in claim 24 wherein said housing is structured to hold one of a predetermined number of lamp assemblies.

26. The retainer as set forth in claim 24 wherein said housing includes an axial bore therethrough to receive and hold therein one of a predetermined number of lamp assemblies.

* * * * *